US007101201B1

(12) United States Patent
McCollum

(10) Patent No.: US 7,101,201 B1
(45) Date of Patent: Sep. 5, 2006

(54) METHOD AND APPARATUS FOR DISABLING ELECTRICAL EQUIPMENT

(76) Inventor: Robert W. McCollum, 3600 Vistra Ridge Dr. West, Mobile, AL (US) 36693

( * ) Notice: Subject to any disclaimer, the term of this patent is extended or adjusted under 35 U.S.C. 154(b) by 0 days.

(21) Appl. No.: 10/976,835

(22) Filed: Oct. 29, 2004

(51) Int. Cl.
*H01R 13/44* (2006.01)

(52) U.S. Cl. ..... 439/133

(58) Field of Classification Search ..... 439/133, 439/341, 723, 152–160, 636–637, 346
See application file for complete search history.

(56) References Cited

U.S. PATENT DOCUMENTS 4,162,516 A * 7/1979 Becker ..... 361/668
4,607,900 A * 8/1986 Andrews et al. ..... 379/445
5,033,973 A * 7/1991 Pruehs et al. ..... 439/167
5,061,199 A * 10/1991 McClead ..... 439/304
6,070,996 A 6/2000 McCollum
6,071,129 A * 6/2000 Konno et al. ..... 439/74

* cited by examiner

*Primary Examiner*—J. F. Duverne
(74) *Attorney, Agent, or Firm*—Kenneth L Tolar

(57) ABSTRACT

A method and an apparatus for disabling power to an electrical device include a flexible conduit electrically coupled with the electrical device having electrical cables received therein. A male plug member is attached to a distal end of the conduit having a plurality of pins each connected to a respective cable. The plug member is hingedly attached to a socket which is in turn electrically coupled with a power source. The male plug may be pivoted into and out of engagement with the socket to selectively enable or disable the electrical device.

10 Claims, 4 Drawing Sheets

METHOD AND APPARATUS FOR DISABLING ELECTRICAL EQUIPMENT

BACKGROUND OF THE INVENTION

The present invention relates to a method and apparatus for quickly and conveniently disabling power to electrical equipment during routine maintenance or replacement.

DESCRIPTION OF THE PRIOR ART

Various electrical machinery and equipment, such as motors, are used in many industrial applications. Such equipment is typically wired to a power source, often via an electrical box. When performing maintenance on the equipment, a worker must disable power using a switch positioned within the electric box or in another location. However, disabling power in such a fashion may also disable power to essential equipment that may be in service. Furthermore, if the electrical box is remote from the equipment, an unsuspecting person may reenable the power, seriously injuring or electrocuting the worker. Additionally, when worn equipment is replaced, the new equipment must be rewired to the electrical source which is laborious and time consuming. Accordingly, there is currently a need for a device that allows a worker to quickly and conveniently disable power to electrical equipment. There is also a need for a device that allows a worker to quickly connect a power source to newly installed equipment.

The prior art reveals at least one device that allows a worker to disable power to an electrical device. U.S. Pat. No. 6,070,996 issued to McCollum discloses a pivotal stanchion assembly including an upper stanchion having a light thereon and a lower stanchion pivotally connected thereto. Each stanchion includes a pair of mating electrical receptacles that power the light when the receptacles are coupled. The device allows the upper stanchion to be pivoted downwardly so that the light can be changed at ground level. However, the device does not allow a worker to disable power to electrical equipment according to the present invention. The present invention provides a uniquely designed method and apparatus that quickly disables power to electrical equipment allowing maintenance to be performed thereon.

SUMMARY OF THE INVENTION

The present invention relates to a method and apparatus for disabling power to electrical equipment. The device comprises a flexible conduit having electrical cables received therein which are electrically connected to the equipment. Fastened to a distal end of the conduit is a male plug member including a cylindrical housing having a plurality of conductive pins positioned adjacent an open end thereof. Each pin is electrically connected to a discrete cable within the conduit interior.

Mounted about the housing is an internally threaded sleeve for securing the male plug member to a mating socket. The socket includes a hollow housing having a connector received therein. On an upper surface of the connector are a plurality of receptacles, each dimensioned and positioned for receiving one of the pins on the male plug member. The socket housing includes an externally threaded upper rim for mating engagement with the internally threaded sleeve on the male plug member. The socket housing is pivotally connected to the plug member housing using a locking, latch mechanism. Electrical cables positioned within an elongated rigid conduit electrically connect the socket receptacles to a power source.

The flexible conduit cables are electrically coupled with an electrical device and the socket cables are electrically connected to a power source. To energize the equipment, a worker pivots the male plug member into electrical engagement with the socket and secures the sleeve to the threaded rim on the socket housing. When performing maintenance or replacing the equipment, the worker unscrews the sleeve and pivots the male plug member out of engagement with the socket.

It is therefore an object of the present invention to provide a method and apparatus that allow a user to quickly and safely disable power to an electrical device.

It is another object of the present invention to provide a method and apparatus that allow workers to safely perform maintenance or repair on electrical equipment.

It is yet another object of the present invention to provide a method and apparatus that eliminate the need to manually wire electrical equipment during installation.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
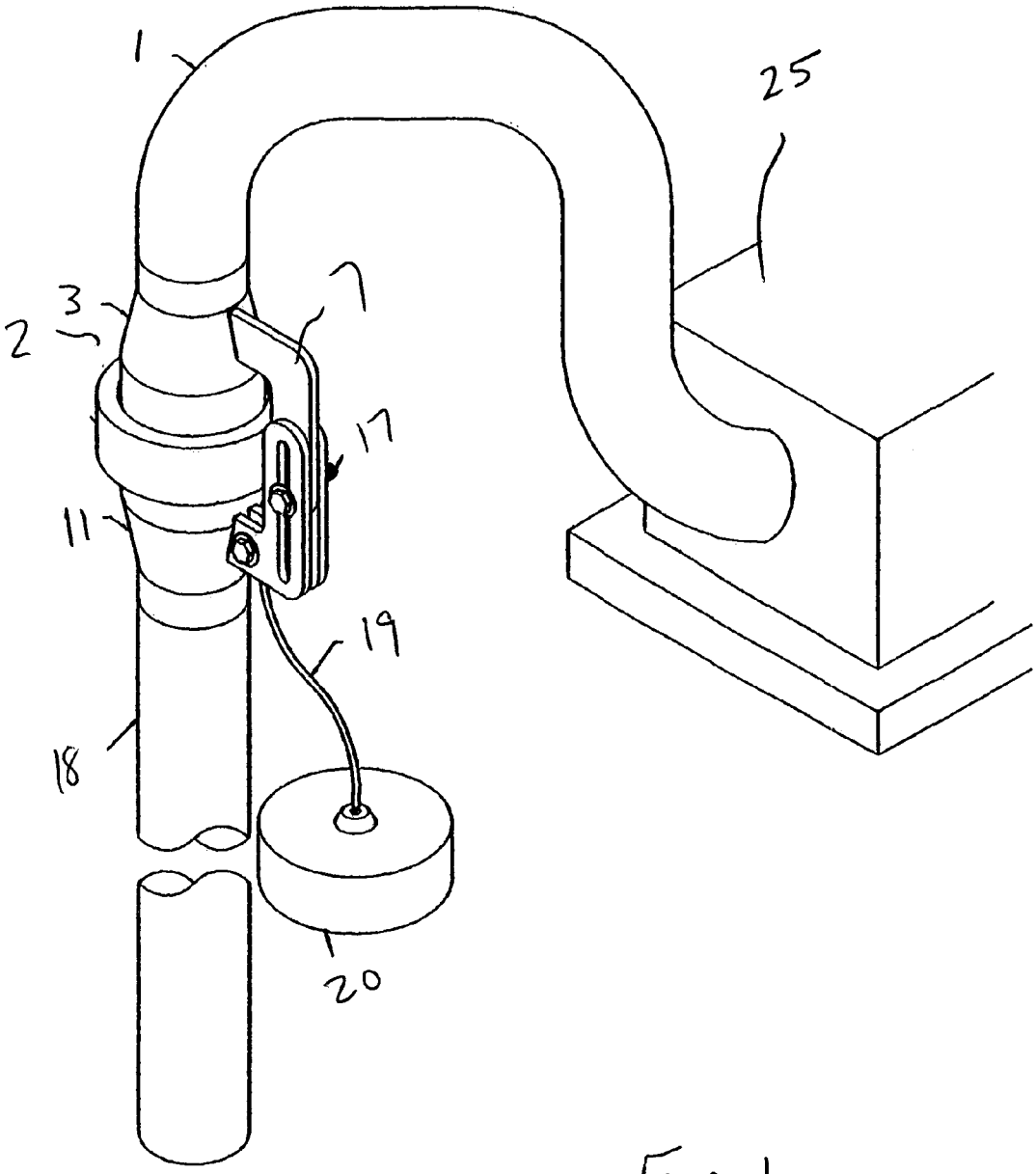
FIG. 1 is perspective view of an electrical device connected to a power source according to the method and apparatus of the present invention.
Figure 2:
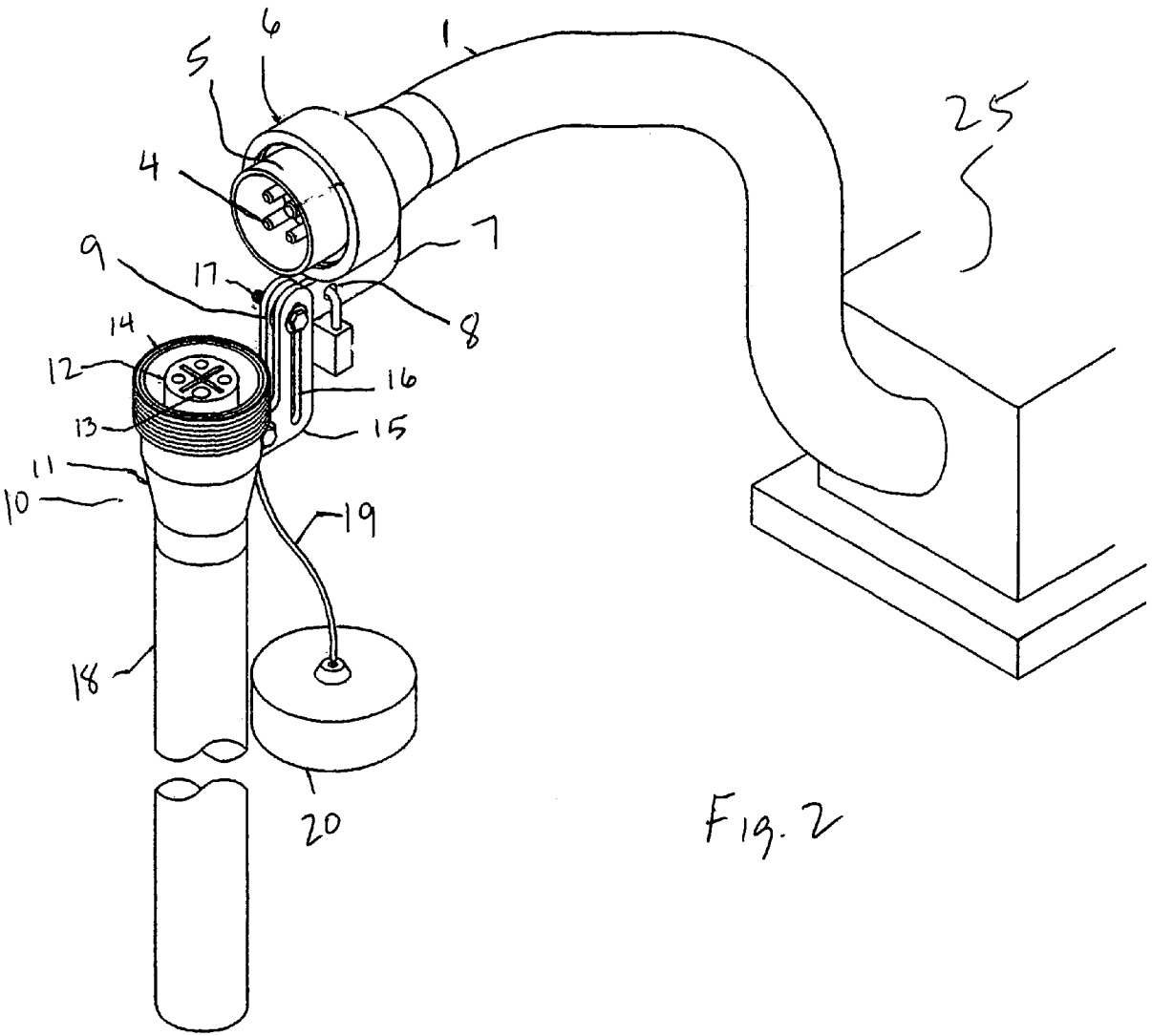
FIG. 2 is a perspective view of the device depicted in FIG. 1 with power disabled according to the method and apparatus of the present invention.
Figure 3:
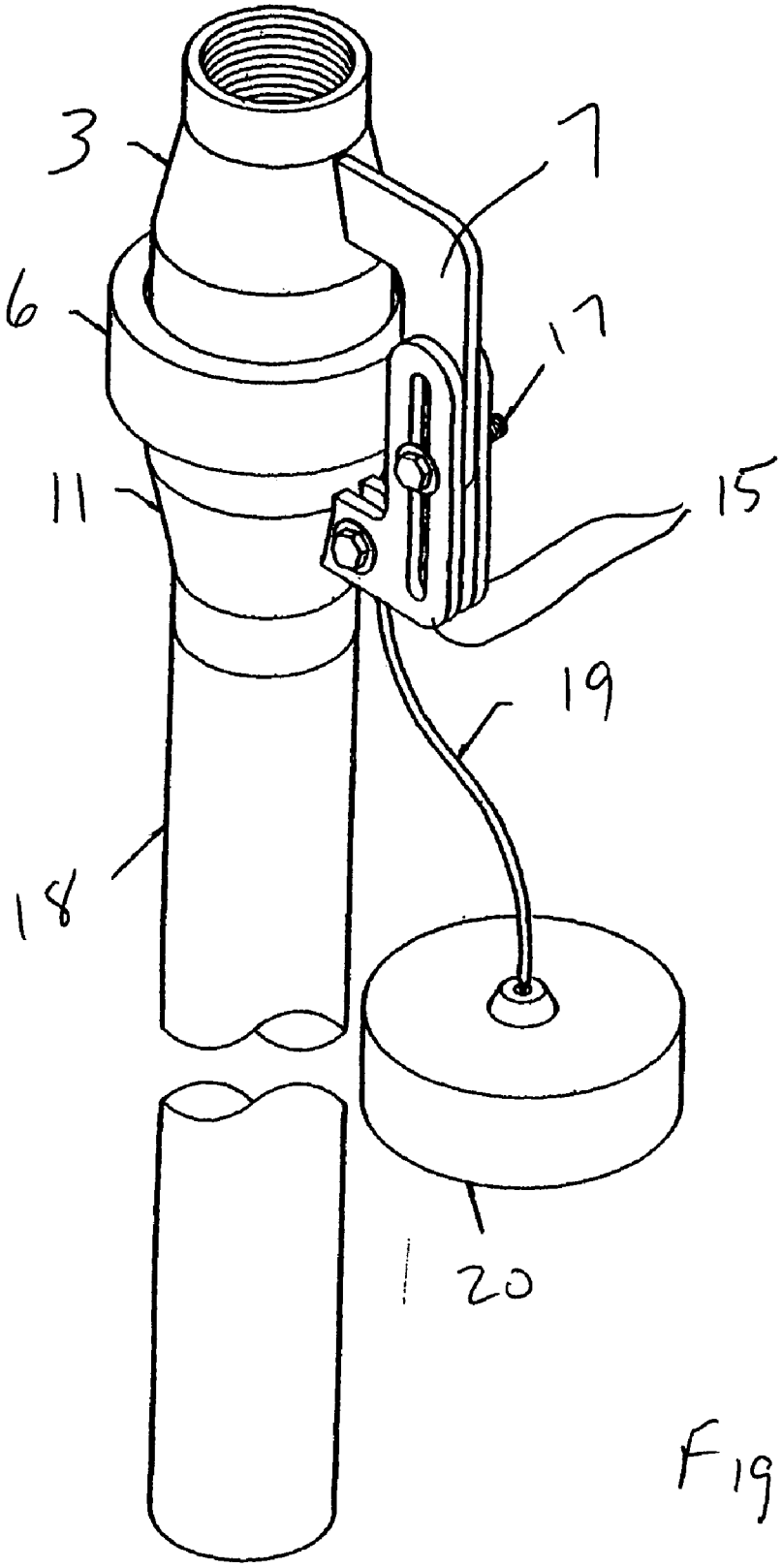
FIG. 3 is a perspective view of the socket and plug member in a coupled configuration.
Figure 4:
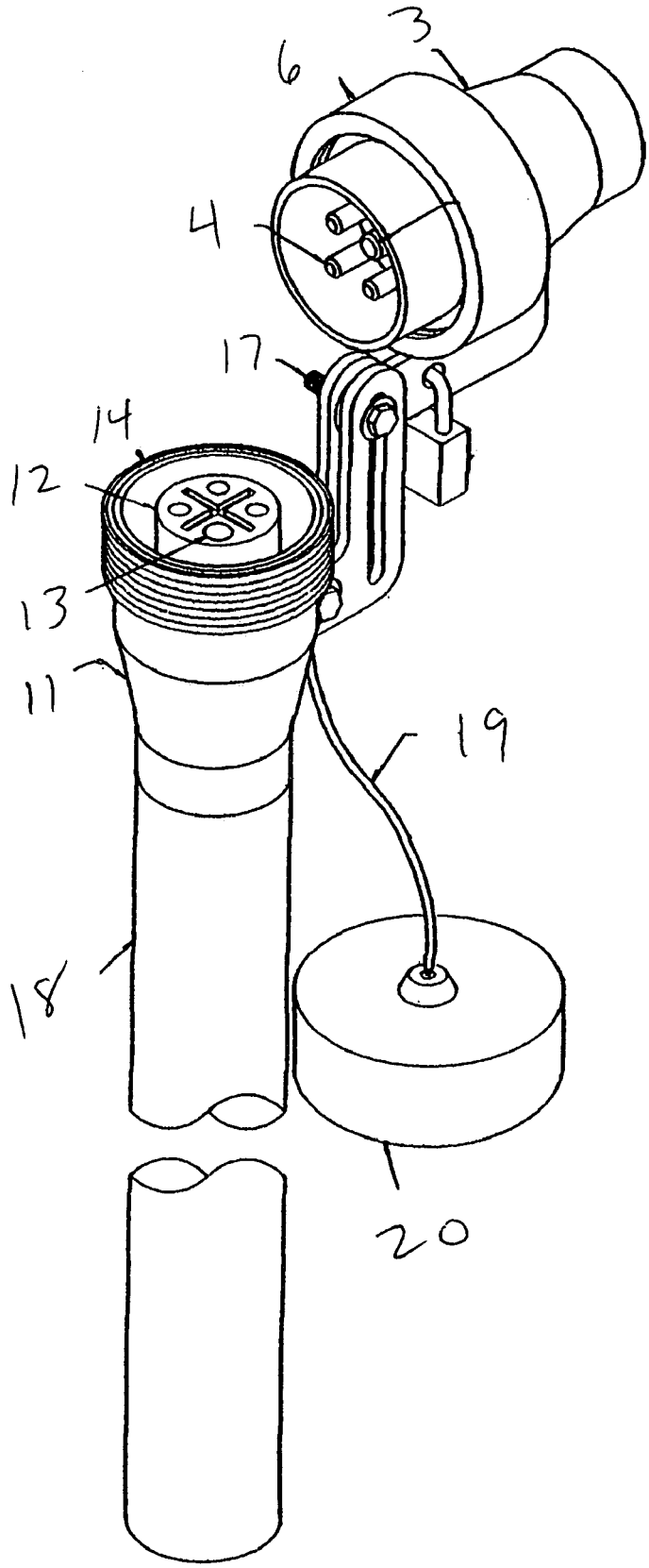
FIG. 4 is a perspective view of the socket and plug member in a power disabling configuration.

Referring now to FIGS. 1–4, the present invention relates to a method and apparatus for disabling power to electrical equipment. The device comprises a flexible conduit 1 having electrical cables received therein which are electrically connected to a piece of equipment, such as an electric motor 25. Fastened to a distal end of the conduit is a male plug member 2 including a cylindrical housing 3 having a plurality of conductive pins 4 positioned therein. The pins are proximal an open end and are each electrically connected to a designated cable within the flexible conduit. Surrounding the pins is a shroud 5 for providing a protective barrier between the pins and the atmosphere. Mounted about the housing is an internally threaded sleeve 6 for securing the male plug member to a socket described in more detail, infra. Extending from the plug housing exterior is an L-shaped latch member 7 having an upper aperture 8 and a lower aperture 9 thereon.

The device further comprises a socket 10 including a hollow housing 11 having a connector 12 received therein. On an upper surface of the connector are a plurality of receptacles 13, each dimensioned and positioned for receiving one of the pins on the male plug member. The socket housing includes an externally threaded upper rim 14 for mating engagement with the internally threaded sleeve on the male plug member. Extending from the socket housing exterior are a pair of spaced, L-shaped flanges 15 each having a longitudinal slot 16 formed thereon. The latch member 7 on the male plug is positioned between the socket flanges and is secured thereto with a locking bolt and nut 17. When the nut and bolt are loosened, the plug member can freely pivot relative to the socket. When the nut and bolt are tightened, the socket and plug member are fixed in a select position. Electrical cables positioned within an elongated rigid conduit 18 electrically connect the socket receptacles to a power source. A tether 19 is fastened to the socket housing and includes an internally threaded cap 20 at a distal end thereof for selectively covering the socket when exposed.

To use the above described device, a worker electrically connects the flexible conduit cables to an electrical device and the socket cables to a power source. The equipment is energized by pivoting the male plug member into engagement with the socket and tightening the bolt that interconnects the latch member and flanges. The protective shroud that surrounds the male plug member seals the resulting electrical connection thereby minimizing any potential for arcing. The internally threaded sleeve is tightly coupled with the externally threaded rim on the socket thereby securing the plug thereto. When performing maintenance or replacing the equipment, the worker simply unscrews the sleeve and pivots the male plug member out of engagement with the socket. As a precaution, a padlock is secured within the upper aperture on the latch member preventing an unsuspecting person from re-coupling the plug with the socket while work is being performed. Simultaneously, the cap member is threadedly secured to the externally threaded rim to prevent the energized socket from being exposed.

If desired, replacement equipment may be equipped with the flexible conduit and male plug member as described above to facilitate installation thereof. In such event, the plug member associated with the worn equipment is separated from the socket by removing the nut and bolt that connect the latch member and flanges. The replacement equipment with the flexible conduit and male plug member is installed in a conventional fashion. The plug member of the replacement equipment is then inserted into the socket and secured by fastening the latch member to the spaced flanges.

The above described device is not limited to the exact details of construction and arrangement of parts provided herein. For example, though the device is primarily designed to disable power to an electric motor, it can be used to disable virtually any electrical device. Additionally, four pins and four mating receptacles are shown so as to allow the device to be used with three-phase motors though the pin and receptacle arrangement can be varied if necessary. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An apparatus for selectively disabling power to an electrical device comprising:

a male plug member electrically connected to an electrical device, said male plug member including a plurality of conductive pins surrounded by a shroud;

a socket member electrically connected to a power source and hingedly joined to said male plug member, said socket member including a plurality of receptacles each for receiving one of said pins whereby said male plug member is pivoted into and out of engagement with said socket member to selectively establish electrical communication therebetween;

means for locking said male plug member in a disengaged position relative to said socket member preventing unauthorized users from re-establishing electrical communication therebetween;

a flexible conduit extending from said male plug member to said electrical device, said conduit receiving a plurality of cables, each cable electrically connected to one of said pins and said electrical device, said flexible conduit allowing said plug member to be maneuvered relative to said socket member without repositioning said electrical device.

2. The apparatus according to claim 1 further comprising:

an L-shaped latch member extending from said male plug member, said L-shaped latch member having an upper aperture and a lower aperture thereon;

a pair of spaced L-shaped flanges extending from said socket member, each flange having a longitudinal slot thereon;

a fastener received within said flange slots and said lower aperture to pivotally couple said male plug member and said socket member.

3. The apparatus according to claim 2 wherein said means for locking said male plug member comprises a lock received within the upper aperture on said latch member that prevents said male plug member from pivoting into mating engagement with said socket member.

4. The apparatus according to claim 1 wherein said male plug member further includes an internally threaded sleeve that selectively engages an externally threaded rim on said socket member to secure said socket member and said male plug member in a mating configuration.

5. The apparatus according to claim 4 further comprising a tether depending from one of said L-shaped flanges, said tether having an internally threaded cap at a distal end for selective engagement with the externally threaded rim on said socket member to selectively encapsulate said socket member receptacles.

6. An apparatus for selectively disabling power to an electrical device comprising:

a male plug member electrically connected to an electrical device;

a socket member electrically connected to a power source and hingedly joined to said male plug member whereby said male plug member is pivoted into and out of engagement with said socket member to selectively establish electrical communication therebetween;

means for locking said male plug member in a disengaged position relative to said socket member preventing unauthorized users from re-establishing electrical communication therebetween;

an internally threaded sleeve on said male plug member that selectively engages an externally threaded rim on said socket member to secure said socket and said male plug in a mating configuration;

a tether depending from said socket member, said tether having an internally threaded cap at a distal end for selective engagement with the externally threaded rim on said socket member to selectively encapsulate said socket member receptacles.

7. The apparatus according to claim 6 wherein said male plug member includes a plurality of conductive pins each selectively receivable within a designated receptacle on said socket member, said pins surrounded by a shroud to provide a safety barrier about said pins when said pins are received within said receptacles.

8. The apparatus according to claim 7 further comprising a flexible conduit extending from said male plug member to said electrical device, said conduit receiving a plurality of cables, each cable electrically connected to one of said pins and said electrical device, said flexible conduit allowing said plug member to be maneuvered relative to said socket member without repositioning said electrical device.

9. The apparatus according to claim 6 further comprising:

an L-shaped latch member extending from said male plug member, said L-shaped latch member having an upper aperture and a lower aperture thereon;

a pair of spaced L-shaped flanges extending from said socket member, each flange having a longitudinal slot thereon;

a fastener received within said flange slots and said lower aperture to pivotally couple said male plug member and said socket member.

10. The apparatus according to claim 9 wherein said means for locking said male plug member comprises a lock received within the upper aperture on said latch member that prevents said plug member from pivoting into mating engagement with said socket member.

* * * * *